US008899510B2

(12) United States Patent
Dean

(10) Patent No.: US 8,899,510 B2
(45) Date of Patent: Dec. 2, 2014

(54) REEL DISPENSER

(75) Inventor: Andrew Dean, Alfreton (GB)

(73) Assignee: Wrap Film Systems Limited (GB)

( * ) Notice: Subject to any disclaimer, the term of this patent is extended or adjusted under 35 U.S.C. 154(b) by 113 days.

(21) Appl. No.: 13/382,896

(22) PCT Filed: Jul. 8, 2010

(86) PCT No.: PCT/GB2010/001308

§ 371 (c)(1),
(2), (4) Date: Jan. 6, 2012

(87) PCT Pub. No.: WO2011/036430

PCT Pub. Date: Mar. 31, 2011

(65) Prior Publication Data

US 2012/0111988 A1 May 10, 2012

(30) Foreign Application Priority Data

Jul. 8, 2009 (GB) ..... 0911799.5

(51) Int. Cl.

| | |
|---|---|
| ***B65H 75/18*** | (2006.01) |
| ***B65H 16/00*** | (2006.01) |
| ***B65H 26/00*** | (2006.01) |
| ***B65H 16/06*** | (2006.01) |

(52) U.S. Cl.

CPC ..... *B65H 16/06* (2013.01); *B65H 2402/63* (2013.01); *B65H 16/005* (2013.01); *B65H 2301/41639* (2013.01); *B65H 26/00* (2013.01); *B65H 2402/61* (2013.01); *B65H 2402/64* (2013.01); *B65H 75/185* (2013.01)

USPC ..... 242/596.7; 242/598.3; 242/599.3

(58) Field of Classification Search

USPC ..... 242/596.7, 597.6, 598, 598.3, 598.4, 242/599, 599.3

See application file for complete search history.

(56) References Cited

U.S. PATENT DOCUMENTS

| | | | | |
|---|---|---|---|---|
| 2,924,494 | A | 2/1960 | Sloier | |
| 5,261,619 | A * | 11/1993 | Merriweather, Jr. | 242/594.3 |
| 5,390,872 | A | 2/1995 | Cipolla | |
| 5,597,135 | A | 1/1997 | Vandersteene | |
| 7,364,112 | B1 | 4/2008 | Formon | |
| 7,780,112 | B2 * | 8/2010 | Granger et al. | 242/599.3 |
| 7,828,240 | B2 * | 11/2010 | Hagleitner | 242/598.3 |
| 2005/0284878 | A1 | 12/2005 | Yu Chen | |
| 2008/0229791 | A1 * | 9/2008 | Granger et al. | 70/182 |
| 2009/0065457 | A1 | 3/2009 | Kostigian | |

OTHER PUBLICATIONS

PCT/GB2010/001308, International Search Report and Written Opinion, Published Mar. 31, 2011, 11 pages.

* cited by examiner

*Primary Examiner* — William A Rivera
(74) *Attorney, Agent, or Firm* — Hall Estill Law Firm

(57) ABSTRACT

A reel dispenser includes a housing, a coupling associated with a reel and a mounting for removably mounting the coupling to the housing so that the coupling is movable between a mounted and a dismounted condition. The coupling includes a key. The mounting includes a lock arrangement which is movable between a locked condition and a free condition. The reel dispenser is arranged so that when the coupling is moved from the dismounted condition to the mounted condition, the key moves the lock arrangement to the free condition, permitting rotation of the coupling relative to the housing.

21 Claims, 9 Drawing Sheets

REEL DISPENSER

CROSS-REFERENCE TO RELATED APPLICATIONS

The present application is a national stage application in accordance with 35 U.S.C. §371 and claims the benefit of priority under 35 U.S.C. §§119 and 365 of international application no. PCT/GB2010/001308, filed Jul. 8, 2010, which claims the benefit of priority of GB Patent Application No. 0911799.5, filed on Jul. 8, 2009, each application being incorporated herein by reference in its entirety.

The present invention relates to a reel dispenser, and a coupling therefor.

Conventionally, reel dispensers comprise an housing, a reel, and a mounting for removably mounting the reel to the housing. The mounting permits rotational movement of the reel to the housing, so that material wound around the reel can be unwound for dispensing. When the material is exhausted from the reel, the reel is dismounted and a fresh reel with new material is mounted in the housing. It can be important for manufacturers of the material to ensure that only specific proprietary material is used within the reel, to ensure that quality is maintained, and for this reason, conventionally, a mounting may include a shaped part which only permits the mounting thereto of reels having a correspondingly shaped end part. However, such shapes can be relatively easily circumvented.

According to a first aspect of the present invention there is provided a reel dispenser, the reel dispenser including a housing, a coupling associated with a reel and a mounting for removably mounting the coupling to the housing so that the coupling is movable between a mounted and a dismounted condition, the coupling including a key, the mounting including a lock arrangement which is movable between a locked condition and a free condition, the reel dispenser being arranged so that when the coupling is moved from the dismounted condition to the mounted condition, the key moves the lock arrangement to the free condition, permitting rotation of the coupling relative to the housing.

According to a second aspect of the present invention, there is provided a reel dispenser coupling, the coupling being associated with a reel and being removably mountable to a mounting of a reel dispenser so that the coupling is movable between a mounted and a dismounted condition, the reel dispenser including a housing, the coupling including a key, the mounting including a lock arrangement which is movable between a locked condition and a free condition, the reel dispenser being arranged so that when the coupling is moved from the dismounted condition to the mounted condition, the key moves the lock arrangement to the free condition, permitting rotation of the coupling relative to the housing.

Possibly, in the free condition, the coupling is rotatable about an axis of rotation.

Possibly, the dispenser includes biasing means, which are arranged to bias the lock arrangement to the locked condition.

Possibly, when the coupling is moved from the dismounted condition to the mounted condition, the key automatically moves the lock arrangement to the free condition.

Possibly, the key moves the lock arrangement to the free condition by movement of the coupling substantially along a direction of engagement. In the mounted condition, the direction of engagement may substantially be along or parallel to the axis of rotation of the coupling.

Possibly, in the free condition, the lock arrangement is rotatable relative to the housing. Possibly, in the locked condition, the lock arrangement is not rotatable relative to the housing.

Possibly, the lock arrangement includes an inner member and an outer member. Possibly, the inner member is located within a cavity defined by the outer member. The outer member may be substantially cylindrical, and may be located within a correspondingly substantially cylindrical cavity defined by the housing.

Possibly, the inner member includes a lock projection, which projects outwardly.

Possibly, the housing defines a lock hole.

Possibly, in the locked condition, the lock projection projects through a lock aperture in the outer member, and may be received within the lock hole, so substantially preventing rotation of the inner and outer members relative to the housing.

Possibly, in the free condition, the lock projection is not received within the lock hole, so permitting rotation of the inner and outer members relative to the housing.

Possibly, as the lock arrangement is moved from the locked to the free condition, the inner member is moved relative to the outer member to withdraw the lock projection from the lock hole.

Possibly, the key is in the form of a projecting key formation. Possibly, the coupling includes a body, and possibly, the key formation projects outwardly from the body. Possibly, the key formation includes an engaging surface, which as the coupling moves from the dismounted condition to the mounted condition, moves the lock arrangement from the locked condition to the free condition. Possibly, the engaging surface is orientated at an oblique angle to the axis of rotation. Possibly, the key includes one or more limit surfaces, which limit movement of the lock arrangement in the free condition.

Possibly, the inner member includes a plurality of lock projections. Possibly, the coupling includes a plurality of key formations, and/or may include a plurality of engaging surfaces. Each of the engaging surfaces may be arranged to move the inner member in a different direction relative to the outer member as the coupling moves from the dismounted condition to the mounted condition.

In one embodiment, the inner member may include two lock projections which may extend outwardly at right angles to each other, and the coupling may include two engaging surfaces which may be arranged to move the inner member in two directions at right angles to each other as the coupling moves from the dismounted condition to the mounted condition.

Possibly, the lock arrangement defines a key hole through which the key must be inserted in moving from the dismounted to the mounted condition. Possibly the key hole is of a relatively unusual shape. Possibly the key has a relatively unusual cross-sectional shape which corresponds with the shape of the key hole.

Possibly, the coupling forms part of the reel The reel may include a reel body, and the coupling may be connectable to the reel body, or the coupling may be formed integrally with the reel body.

Possibly the reel dispenser is for dispensing a material, which may be wound around the reel, and may be food wrap, and may be formed of a plastics material, and may be formed of polyethylene.

According to another aspect of the present invention, there is provided a method of mounting a reel in a reel dispenser, the method including providing a reel dispenser, the reel dispenser including a housing, a coupling associated with a reel and a mounting for removably mounting the coupling to the housing so that the coupling is movable between a mounted and a dismounted condition, the coupling including a key, the mounting including a lock arrangement which is movable between a locked condition and a free condition, and moving the coupling from the dismounted condition to the mounted condition, the reel dispenser being arranged so that when the coupling is moved from the dismounted condition to the mounted condition, the key moves the lock arrangement to the free condition, permitting rotation of the coupling relative to the housing.

Possibly, the reel dispenser is as described in any of the preceding paragraphs.

Embodiments of the present invention will now be described, by way of example only, and with reference to the accompanying drawings in which:

FIG. 1A is a schematic, part cross sectional view of a reel dispenser with a reel in a mounted condition and a lock arrangement in a free condition, while

Figure 1A:
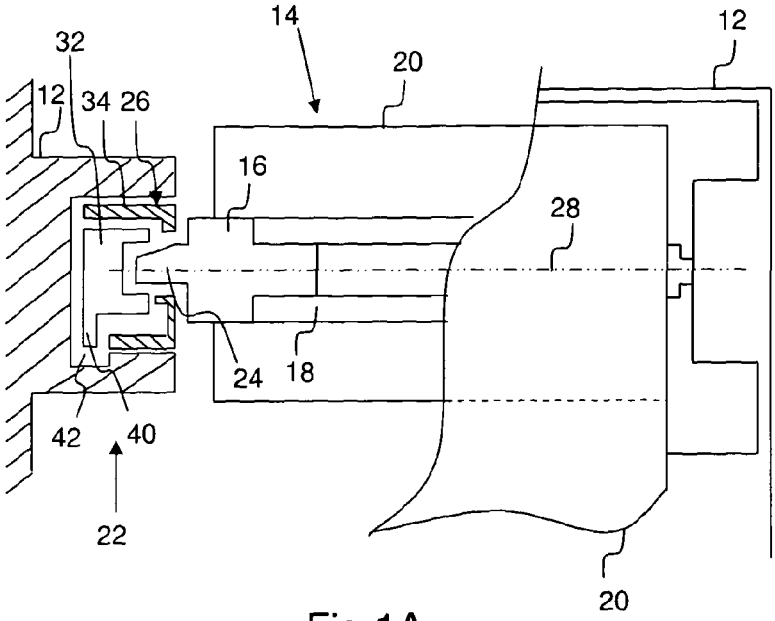
Figure 1B:
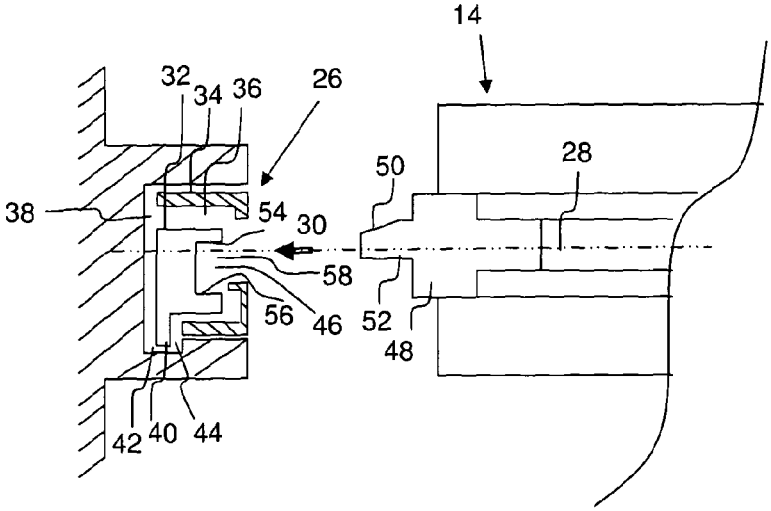
FIG. 1B is an enlarged detail of the cross sectional view of the reel dispenser of FIG. 1 with the reel in a dismounted condition and the lock arrangement in a locked condition.
Figure 2:
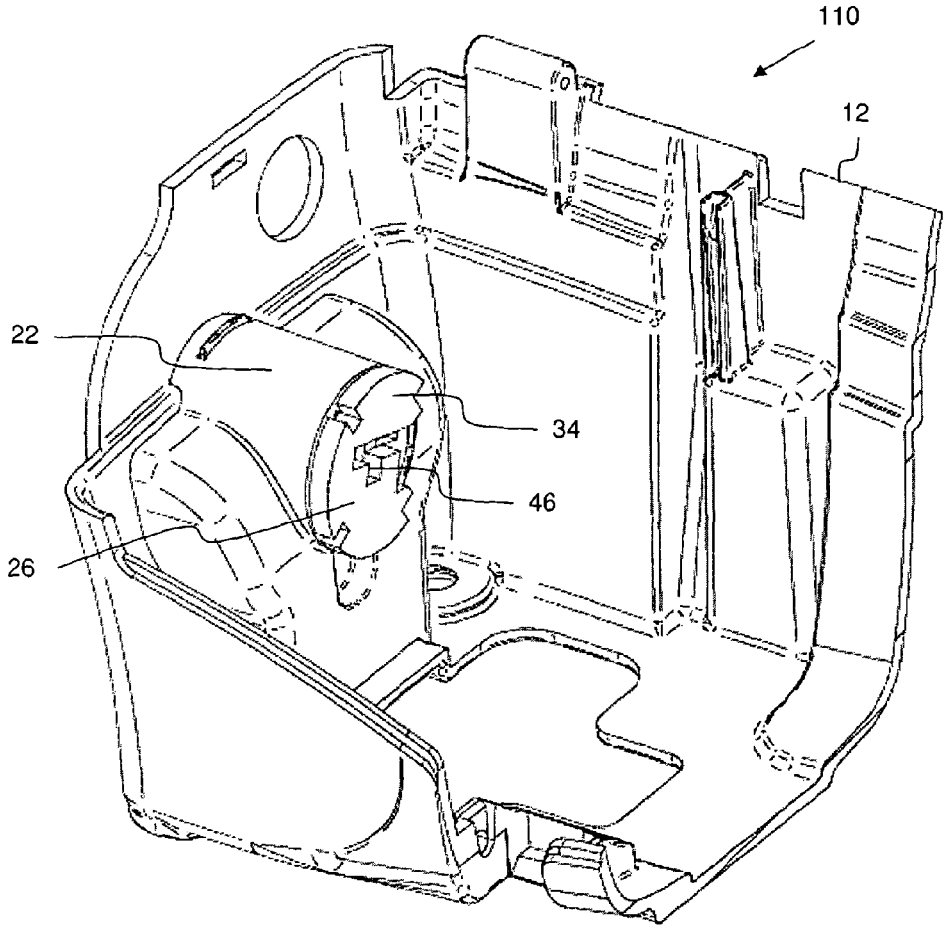
FIG. 2 is a perspective view of part of another reel dispenser.

FIGS. 1 and 2 show a reel dispenser 10, the reel dispenser 10 including a housing 12, a coupling 16 associated with a reel 14 and a mounting 22 for removably mounting the coupling 16 to the housing 12. The reel 14 includes a reel body 18 which is in the form of a tube and is connected to the coupling 16. Material 20 in the form of food wrap is wound around the reel body 18 and overlapping the coupling 16. The food wrap could be formed of a plastics material, and could be formed of polyethylene. The overlapping winding of the material 20 around the coupling 16 helps prevent unauthorized disconnection of the coupling 16 from the reel body 18.

The coupling 16 includes a body 48 and a key in the form of a projecting key formation 24, which projects outwardly from the body 48 generally along or parallel to an axis of rotation 28 of the reel 14.

The projecting key formation 24 has a non-circular axial cross-sectional shape, and includes an engaging surface 50, which is orientated at an oblique angle to the axis 28, and a limit surface 52, which is orientated generally oppositely away from the engaging surface 50.

The mounting 22 includes a lock arrangement 26, including an inner member 32 and a substantially cylindrical outer member 34. The inner member 32 is located within a cavity 36 defined by the outer member 34. The cylindrical outer member 34 is located within a correspondingly substantially cylindrical cavity 38 defined by the housing 12. The outer member 34 defines a key hole 46 having a shape which corresponds to the noncircular cross-sectional shape of the key formation 24.

The housing 12 defines a lock hole 42 which extends radially outwardly from the housing cavity 36. In the example shown in FIGS. 1A and 1B, the lock hole 42 is a blind hole.

The lock arrangement 26 includes a lock projection 40 which projects radially outwardly from the inner member 32 and through a lock aperture 44 defined by the outer member 34.

In the plane of the paper as shown in FIGS. 1A and 1B, (ie a substantially vertical plane aligned along the axis 28) the inner member 32 is a relatively loose fit within the outer member 34, and is movable between an upper engaged position as shown in FIG. 1A and a lower locked position as shown in FIG. 1B. In the lower locked position, the lock projection 40 is received within the lock hole 42, substantially preventing rotational movement of the lock arrangement 26 relative to the housing 12. The lock arrangement 26 is biased to the lower locked position by gravity. If the lock projection 40 is rotationally misaligned relative to the lock hole 42, any rotation of the lock arrangement 26 will cause the lock projection 40 to drop into the lock hole 42, preventing further rotational movement of the lock arrangement 26 relative to the housing 12. The arrangement of the lock hole 42 extending substantially downwardly from the housing cavity 38 thus comprises biasing means.

In the upper engaged position, the lock projection 40 is not received within the lock hole 42, permitting rotation of the lock arrangement 26 relative to the housing 12.

The inner member 32 defines a key receiving recess 58 and includes a downwardly orientated engaging surface 54 and an oppositely, upwardly orientated limit surface 56. The key receiving recess 58 could have an axial cross-sectional shape which corresponds to the noncircular cross-sectional shape of the key formation 24.

In use, the reel 14 is initially in a dismounted condition as shown in FIG. 1B, the inner member 32 is in the lower locked position, and the lock arrangement 26 is in the locked condition, so that rotational movement of the lock arrangement 26 is substantially prevented.

The reel 14 is moved to the mounted condition by inserting the key formation 24 through the key hole 46 into the outer member cavity 36 along a direction of engagement as shown by arrow 36 in FIG. 1B, which is substantially along or parallel to the axis 28. As the key formation 24 moves therealong, the key formation engaging surface 50 contacts the inner member engaging surface 54, the slope of the key formation engaging surface 50 causing the inner member 32 to move upwardly within the outer member 34 from the lower locked position to the upper engaged position, in which the lock projection 40 is clear of the lock hole 42. In the mounted condition, the inner member 32 is in the upper engaged position and the lock arrangement 26 is in the free condition, permitting rotation of the reel 14 and the lock arrangement 26 relative to the housing 12.

In the mounted condition, the key formation limit surface 52 substantially abuts the inner member limit surface 56, and the radially outermost part of the key formation engaging surface 50 substantially abuts the inner member engaging surface 54, so that during rotation, the inner member 32 is held securely in the engaged position within the outer member cavity 36.

The reel 14 is dismounted from the mounting 22 by moving the reel 14 along the axis 28 in a direction opposite to the direction of engagement 30. As the key formation 24 is withdrawn from the key receiving recess 58, the inner member 32 will be released and will move as described above to the lower locked position, in which the lock arrangement 26 is in the locked condition.

At the other end of the reel 14 from the coupling 16, a second coupling similar to coupling 16 could be provided for engagement with a mounting similar to the mounting 26, or alternatively, the reel 14 could have a relatively simple arrangement such as a stub axle, which is receivable within a drop-in mounting on the housing 12.

The shape of the key hole 46 and the cross-sectional shape of the key formation 24 could be of any suitable shape and, advantageously, could be of a relatively unusual shape to increase the difficulty of providing unauthorized reels.

There is thus provided a reel dispenser having a number of advantages over conventional arrangements. The reel dispenser of the invention prevents use with a reel which does not have a coupling with a key of the correct shape, which must be arranged both to fit through the key hole, and also move the lock arrangement to the free condition. The reel dispenser of the invention provides a key which moves the lock arrangement to the free condition simply by inserting the correct key generally along the axis of rotation.

In another arrangement, the lock hole could be located in a different position, and the biasing means could include a spring loaded arrangement which could bias the lock projection and/or the inner member to the locked position. The lock arrangement could include a plurality of lock projections. The housing could define a plurality of lock holes. The key hole could be of any suitable shape, corresponding to the cross-sectional shape of the key.

FIGS. 2 to 11 show alternative embodiments of the invention, many features of which are similar to those described above in relation to FIGS. 1A and 1B. Where features are the same or similar, the same reference numerals have been used, and these features will not be described again for the sake of brevity.

FIG. 2 shows part of a reel dispenser 110, the reel dispenser 110 including a housing 12, and a mounting 22. The mounting 22 includes a lock arrangement 26, including an inner member 32 and a substantially cylindrical outer member 34. The outer member 34 defines a key hole 46, which in this embodiment is in the shape of an "F".

Figure 3:
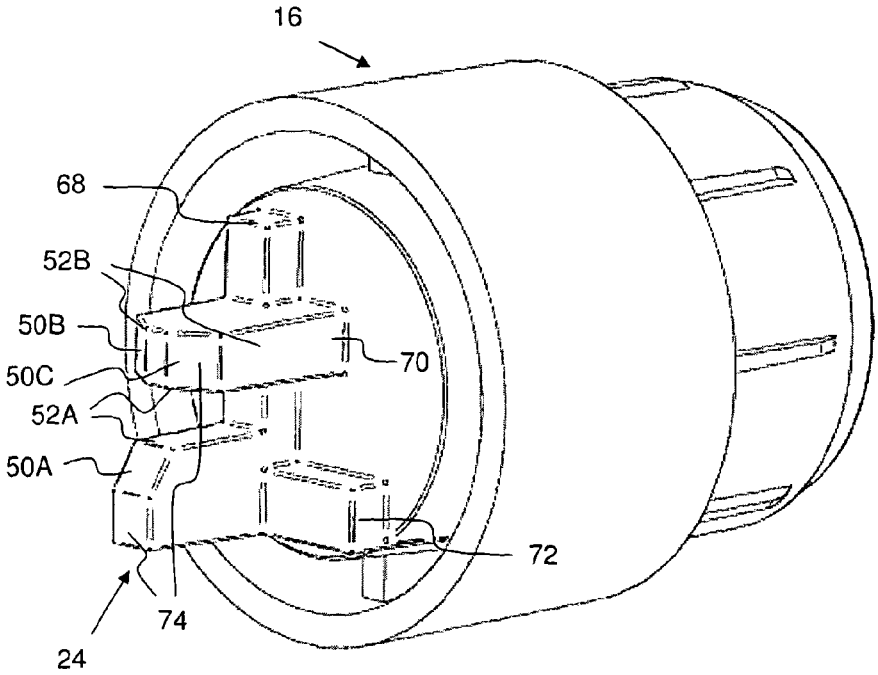
FIG. 3 is a perspective view of a coupling of the reel dispenser of FIG. 2.
Figure 4:
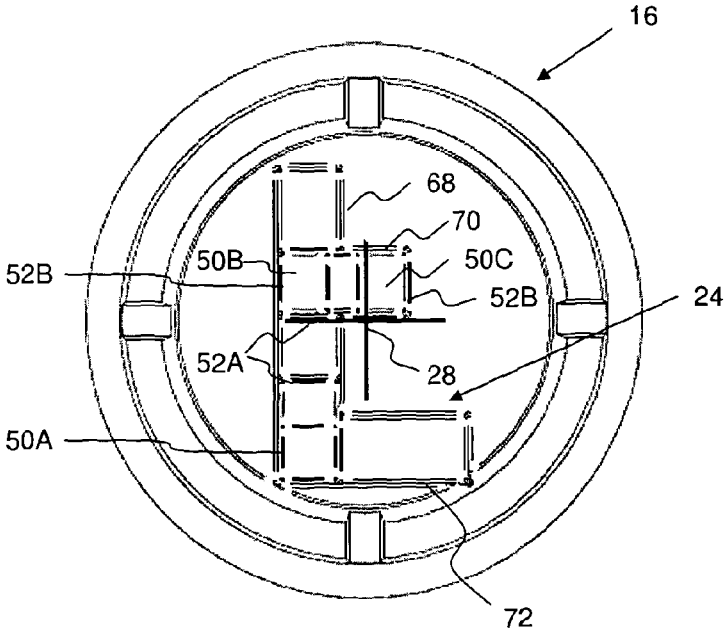
FIG. 4 is an end view of the coupling.

The reel dispenser 110 includes a coupling 16 as shown in FIGS. 3 and 4. The coupling 16 includes a key in the form of a projecting key formation 24, which has a cross-sectional shape in the shape of an "F", corresponding to the shape of the key hole 46, the "F" having a stem 68, a larger side branch 72 and a smaller side branch 70. The stem 68 of the "F", when viewed end on as shown in FIG. 4, is offset from the axis of rotation 28 of the coupling 16.

The key formation 24 includes a generally inwardly facing first key formation engaging surface 50A, which is formed on a raised portion 74 of an upper part of the stem 68, and is orientated at an oblique angle to the axis 28. The key formation 24 includes a pair of generally oppositely outwardly facing second key formation engaging surfaces 50B and 50C which are formed on a raised portion 74 of the smaller side branch 70, and are each orientated at an oblique angle to the axis 28.

The key formation 24 includes a pair of oppositely inwardly facing first key formation limit surfaces 52A which are formed on the raised portion 74 of the upper part of the stem 68 and the raised portion 74 of the smaller side range 70, and a pair of oppositely outwardly facing second key formation limit surfaces 52B which are formed on the raised portion 74 of the smaller side branch 70.

Figure 5:
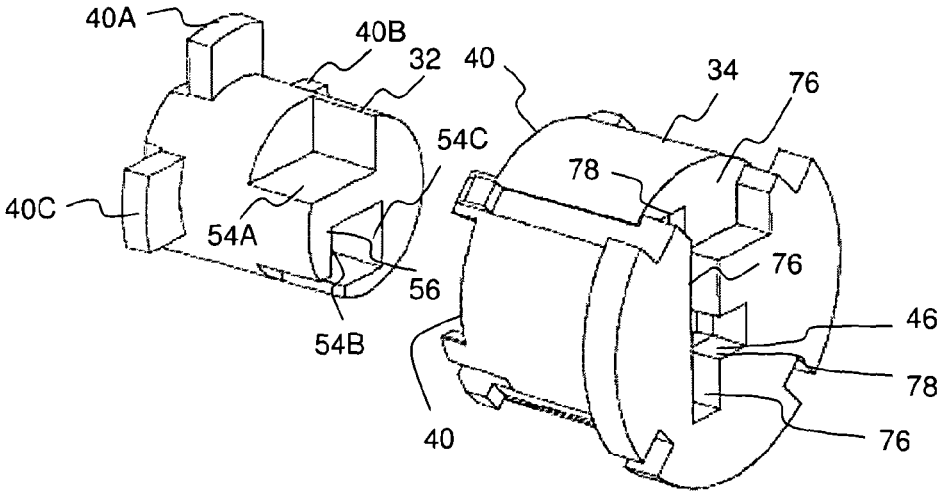
FIG. 5 is a perspective exploded view of a lock arrangement of the reel dispenser of FIG. 2.
Figure 6:
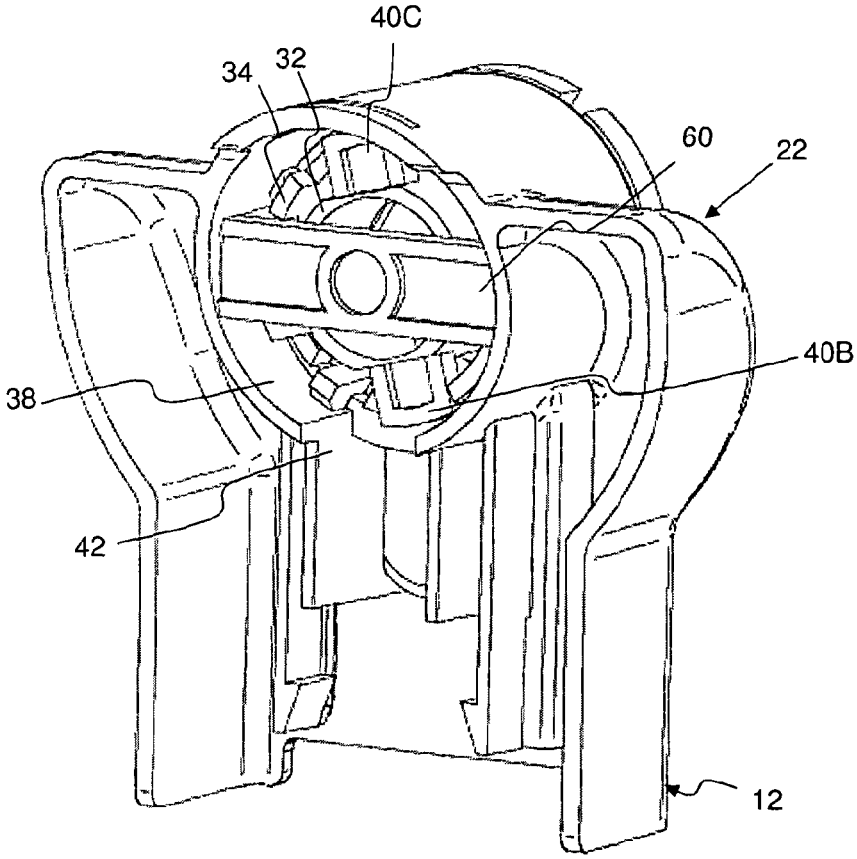
FIG. 6 is a perspective view of part of the reef dispenser of FIG. 2 to in a free condition.

FIG. 5 shows the lock arrangement 26 in an exploded condition. The lock arrangement includes a in a member 32 and the outer member 34. The outer member 34 defines a keyhole 46, which includes blind portions 76 and through portions 78. The keyhole 46 is in the shape of an "F", corresponding with the shape of the key formation 24. The blind portions 76 correspond in location with the unraised portions of the key formation 24, and the through portions 78 correspond in location with the raised portions 74.

In this embodiment, the lock arrangement 26 includes three lock projections 40A, 40B and 40C which project radially outwardly from the inner member 32. Side lock projections 40B and 40C extend approximately at right angles relative to central lock projection 40A.

The inner member 32 includes a first inner member engaging surface 54A and an oppositely facing inner member limit surface 56; and a pair of opposed, inwardly facing second engaging surfaces 54B, 54C.

The housing 12 includes a stop member 60 which extends across the housing cavity 38 to hold the lock arrangement 26 in position.

Figure 7:
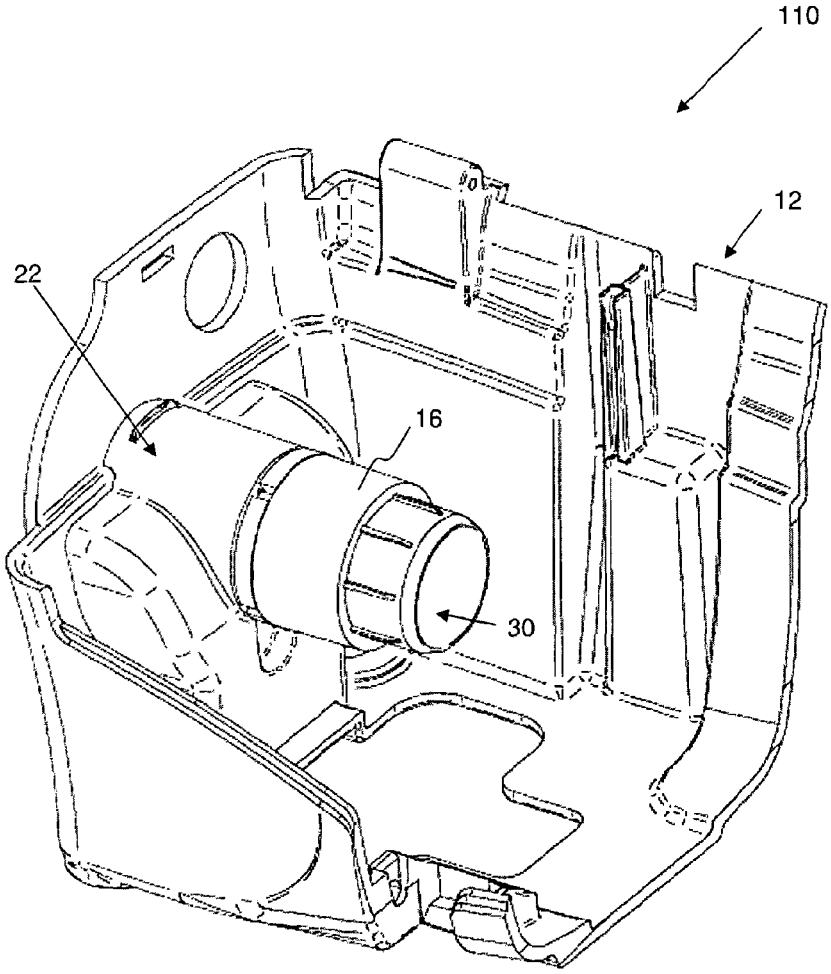
FIG. 7 is a perspective view of part of the reel dispenser of FIGS. 2 to 6 with the coupling in a mounted condition.
Figure 8:
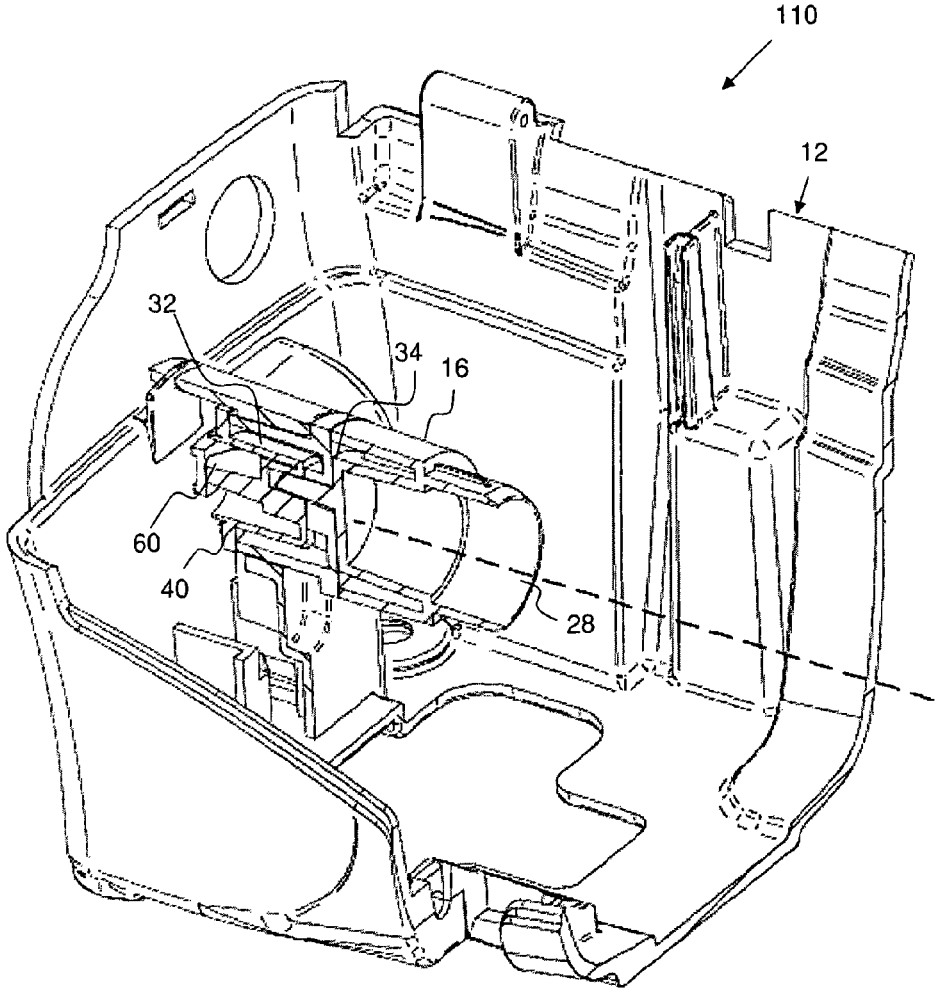
FIG. 8 is a perspective, part cross sectional view of the part of the reel dispenser shown in FIG. 7 with the coupling in the mounted condition.
Figure 9B:
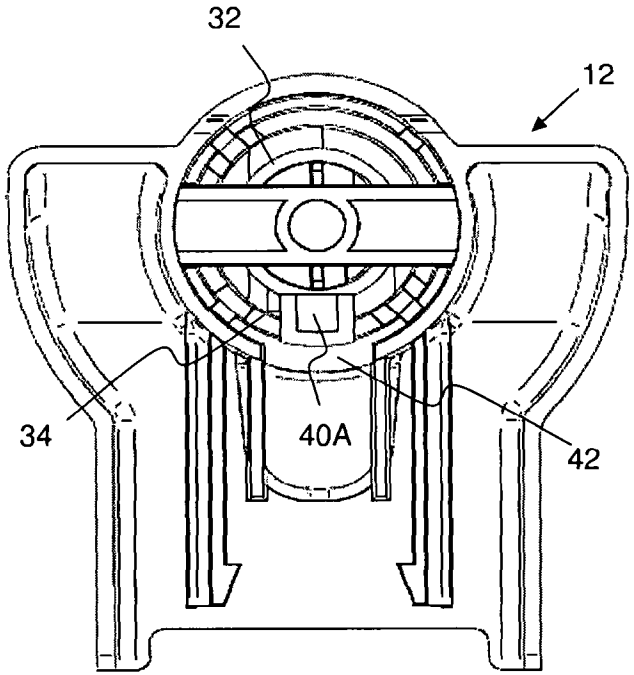
FIGS. 9A and 9B are end views of the part of the reel dispenser shown in FIG. 6 in a locked condition and in the free condition respectively.
Figure 9A:
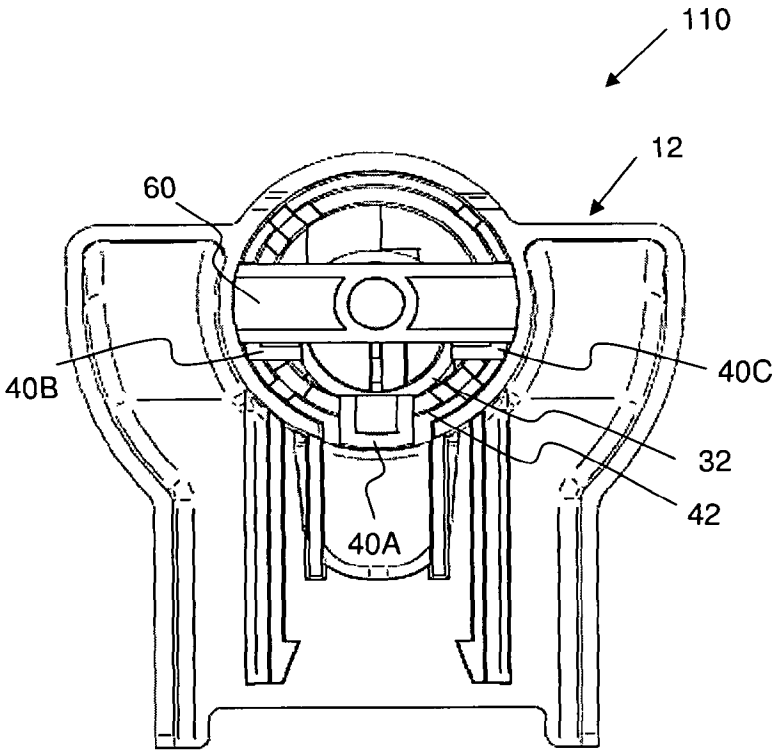

FIGS. 7 to 9 show the reel dispenser 110 in use. FIG. 9A shows the reel dispenser 110 with the coupling 16 in the dismounted condition and the lock arrangement 26 in a locked condition. In this condition, the lock projection 40A is received within the lock hole 42, substantially preventing rotation of the lock arrangement 26 relative to the housing 12. In this embodiment, any one of the three lock projections 40A, 40B, 40C could be received within the lock hole 42.

The coupling 16, in association with a reel body 18 and wound material 20 (not shown), is moved from a dismounted condition to a mounted condition by inserting the key formation 24 along a direction of engagement 30, which is generally along or parallel to the axis of rotation 28 of the reel 14, into the keyhole 46. As the key formation 24 moves into and through the keyhole 46, the key formation engaging surfaces 50A, 50B, 50C engage the corresponding inner member engaging surfaces 54A, 54B, 54C to move the inner member 32 relative to the outer member 34, so that the lock projection 40A is moved out of the look hole 42, permitting the lock arrangement 26 and the mounted reel 14 with the coupling 16 to rotate relative to the housing 12.

In the mounted condition, the inner member 32 is held securely in the engaged position by the abutment of the first key formation limit surfaces 52A with the inner member engaging surface 54 and the inner member limit surface 56, and the abutment of the second key formation limit surfaces 52B with the second inner member engaging surfaces 54B, 54C.

The careful configuration of the engaging surfaces and limit surfaces of the key formation and the inner member, and the plurality of lock projections permits the locking and releasing of the lock arrangement in a plurality of rotational positions. This provides the advantage of additional security in the locked condition. The increased complexity also increases the difficulty of providing a substitute or counterfeit coupling.

In one example, the different raised portions of the key formation 24 could be at different levels, so that movement of the inner member 32 relative to the outer member 34 occurs in stages. In one example, this results in smoother easier mounting of the coupling 16. In another example, such an arrangement results in a coupling with a key formation which did not have the raised portions at different levels being unable to be successfully mounted.

Figure 10:
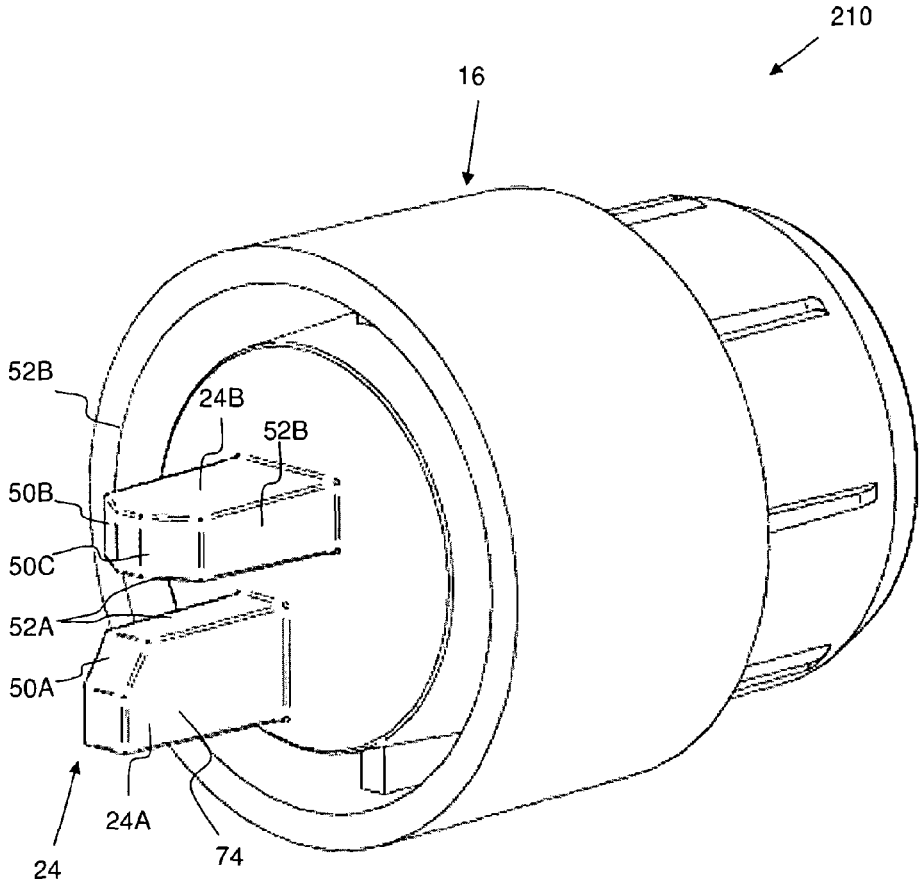
FIG. 10 is a perspective view of another coupling.

FIG. 10 shows part of another reel dispenser 210 comprising a coupling 16 including a key formation 24 including a pair of projections 24A, 24B. The projections 24A, 24B are essentially the raised portions 74 of the formation 24 of the embodiment shown in FIG. 3, and have the same arrangement of engaging surfaces 50 and limit surfaces 52. The coupling 16 shown in FIG. 10 could therefore be used as an alternative to the coupling 16 shown in FIG. 3 for mounting to the mounting 22 of the reel dispenser 110. The advantage of the coupling 16 shown in FIG. 3 is that the unraised portions of the key formation 24 provide additional strength.

Figure 11:
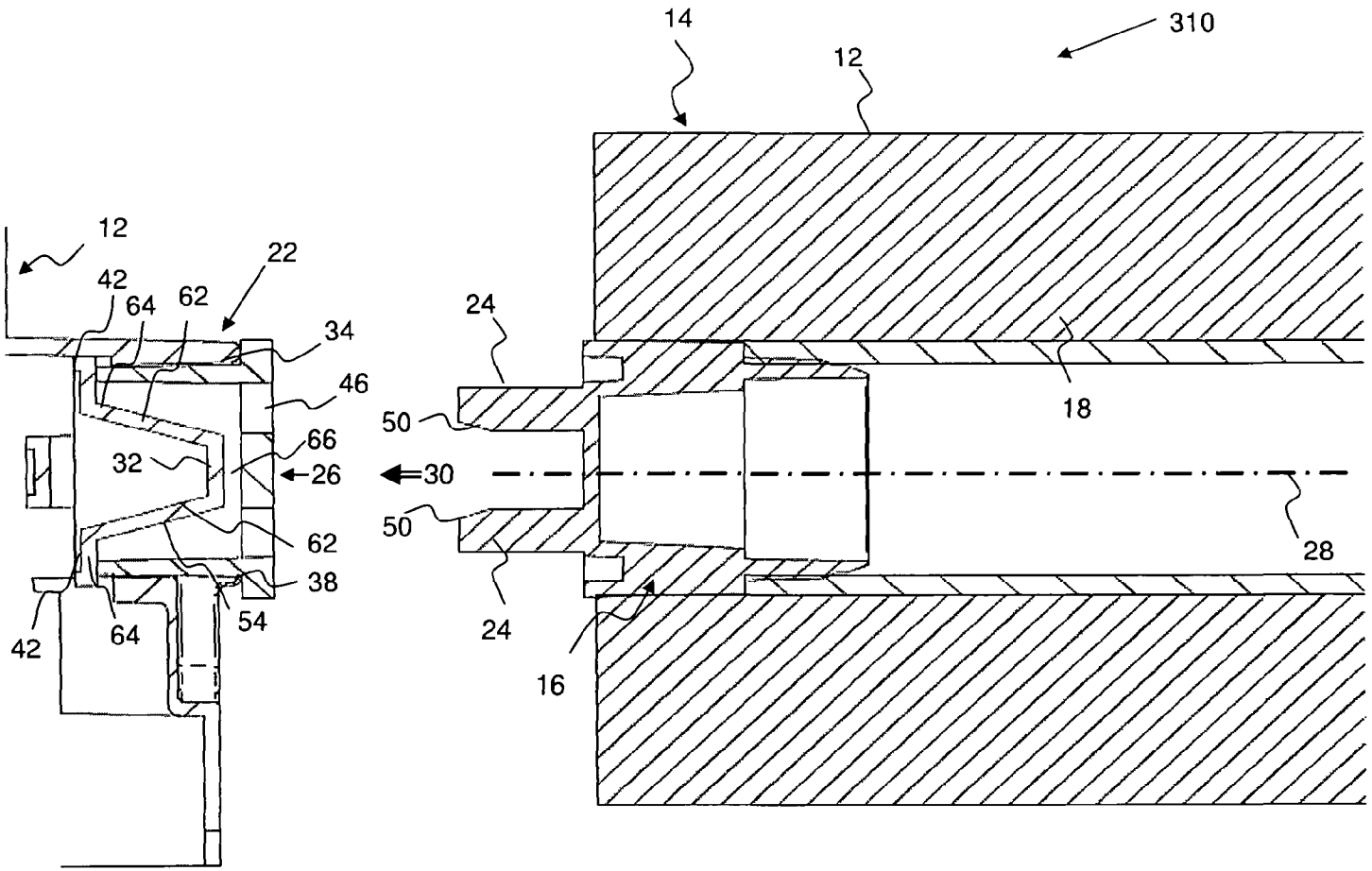
FIG. 11 is a perspective cross sectional view of part of yet another reel dispenser with a reel in a dismounted condition and a lock arrangement in a locked condition.

FIG. 11 shows another embodiment of the invention. A reel dispenser 310 includes housing 12 and a mounting 22, the mounting 22 includes a lock arrangement 26, and the lock arrangement 26 includes an inner member 32 and an outer member 34.

The outer member 34 defines a plurality of keyholes 46.

The inner member includes a body portion 66, a plurality of leg portions 62 extending from the body portion 66 at an oblique angle away from each other, each leg portion 62 including an outwardly turned toe portion 64. The leg portions 62 are resiliently deformable relative to the body portion 66 between an extended position and a retracted position. Each leg portion 62 includes an engaging surface 54.

The housing 12 includes a housing cavity 38 in which the lock arrangement 26 is located, a plurality of lock holes 42 extending outwardly from the housing cavity 38.

The reel dispenser 310 includes a coupling 16 including a key in the form of a plurality of spaced projecting key formations 24, each key formation 24 including a generally inwardly facing engaging surface 50, which is orientated at an oblique angle relative to the axis of rotation 28. The cross-sectional shapes of the key formations 24 correspond to the shapes of the keyholes 46.

In a dismounted condition, the lock arrangement 26 is in a locked condition, in which each of the leg portions 62 is in the extended position, so that the toe portions 64 extend through lock apertures 44 defined by the outer member 34 and are received within the lock holes 42, so that rotation of the lock arrangement 26 relative to the housing 12 is substantially prevented.

To move to the mounted condition, the coupling 16 is moved generally along a direction of engagement 30 along or parallel to the axis 28 so that the key formations 24 pass through the keyholes 46, and the key formation engaging surfaces 50 contact the inner member engaging surfaces 54. As the movement continues, the leg portions 62 deformed from the extended position to the retracted position, in which the toe portions 64 no longer received within the lock holes 42, permitting rotation of the lock arrangement 26, the coupling 16 and the reel 14.

In one example, a plurality of leg portions 62 are equally spaced around the body portion 66 of the inner member 32, which provides the advantage that the inner member 32 is self centralizing.

The inner member 32 could include any suitable number of leg portions, from one upwards, and the housing 12 could define any suitable number of lock holes 42 from one upwards. The coupling 16 could include any suitable number of key formations, which may or may not correspond with the number of leg portions. In one example, one key formation could deform several leg portions.

In another example, the key formations of FIG. 11 could be combined with those of earlier embodiments along with the keyhole of earlier embodiments, so that the appearance of the key formation arrangement is relatively complex and yet provides the generally inwardly facing engaging surfaces required to deform the leg portions.

Various other modifications could be made without departing from the scope of the invention. The various components could be formed of any suitable material, and for example could be formed of plastics material, and could be formed by injection moulding. The lock arrangement and coupling could be of any suitable size and shape. The key formation and keyhole could be of any suitable size and shape.

The invention encompasses any suitable Combination of any of the features shown in any of the embodiments There is thus provided a reel dispenser including a key and lock arrangement which helps to ensure that any reels provided by an authorized supplier can be used in the dispenser, while providing simple fitting of the reels to the dispenser housing.

While endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A reel dispenser housing and mounting, for a reel dispenser, the dispenser including in use the housing, a coupling associated with a reel and the mounting, the mounting being arranged to permit removable mounting of the coupling to the housing so that the coupling is movable between a mounted and a dismounted condition, the coupling including a key, the key is in the form of a projecting key formation, the coupling includes a body, and the key formation projects outwardly from the body, the mounting including a lock arrangement which is movable between a locked condition and a free condition, the mounting being arranged so that when the coupling is moved from the dismounted condition to the mounted condition, the key moves the lock arrangement to the free condition, permitting rotation of the coupling relative to the housing.

2. A reel dispenser housing and mounting according to claim 1, in which the mounting includes biasing means, which are arranged to bias the lock arrangement to the locked condition.

3. A reel dispenser housing and mounting according to claim 1, in which, in the free condition, the lock arrangement is rotatable relative to the housing, and in the locked condition, the lock arrangement is not rotatable relative to the housing.

4. A reel dispenser housing and mounting according to claim 1, in which the lock arrangement includes an inner member and an outer member.

5. A reel dispenser housing and mounting according to claim 4, in which the inner member is located within a cavity defined by the outer member.

6. A reel dispenser housing and mounting according to claim 4, in which the outer member is substantially cylindrical, and is located within a correspondingly substantially cylindrical cavity defined by the housing.

7. A reel dispenser housing and mounting according to claim 4, in which the inner member includes a lock projection, which projects outwardly, the housing defines a lock hole, and wherein, in the locked condition, the lock projection projects through a lock aperture in the outer member, and is received within the lock hole, so substantially preventing rotation of the inner and outer members relative to the housing, and in the free condition, the lock projection is not received within the lock hole, so permitting rotation of the inner and outer members relative to the housing.

8. A reel dispenser housing and mounting according to claim 7, in which as the lock arrangement is moved from the locked to the free condition, the inner member is moved relative to the outer member to withdraw the lock projection from the lock hole.

9. A reel dispenser housing and mounting according to claim 1, in which the lock arrangement defines a key hole through which the key must be inserted in moving from the dismounted to the mounted condition.

10. A reel dispenser coupling for a reel dispenser cooperable with the housing and mounting of claim 1, the coupling being associated with a reel, the mounting being arranged in use to permit removable mounting of the coupling to the housing so that the coupling is movable between a mounted and a dismounted condition, the coupling including a key, the mounting including a lock arrangement which is movable between a locked condition and a free condition, the mounting being arranged so that when the coupling is moved from the dismounted condition to the mounted condition, the key moves the lock arrangement to the free condition, permitting rotation of the coupling relative to the housing.

11. A reel dispenser coupling according to claim 10, in which, in the free condition, the coupling is rotatable about an axis of rotation.

12. A reel dispenser coupling according to claim 10, in which the key formation includes an engaging surface, which as the coupling moves from the dismounted condition to the mounted condition, moves the lock arrangement from the locked condition to the free condition.

13. A reel dispenser coupling according to claim 12, in which the coupling includes a plurality of engaging surfaces.

14. A reel dispenser coupling according to claim 13, in which each of the engaging surfaces is arranged to move the inner member in a different direction relative to the outer member as the coupling moves from the dismounted condition to the mounted condition.

15. A reel dispenser coupling according to claim 10, in which the key includes one or more limit surfaces, which limit movement of the lock arrangement in the free condition.

16. A reel dispenser coupling according to claim 10, in which the coupling includes a plurality of key formations.

17. A reel dispenser coupling according to claim 10, in which the coupling forms part of the reel, the reel including a reel body, and the coupling is connectable to the reel body, or the coupling is formed integrally with the reel body.

18. A reel dispenser including a housing, a coupling associated with a reel and a mounting for removably mounting the coupling to the housing so that the coupling is movable between a mounted and a dismounted condition, the coupling including a key, the key is in the form of a projecting key formation, the coupling includes a body, and the key formation projects outwardly from the body, the mounting including a lock arrangement which is movable between a locked condition and a free condition, the reel dispenser being arranged so that when the coupling is moved from the dismounted condition to the mounted condition, the key moves the lock arrangement to the free condition, permitting rotation of the coupling relative to the housing.

19. A reel dispenser according to claim 18, in which the reel dispenser is for dispensing a material, which is wound around the reel.

20. A reel dispenser according to claim 19, in which the material for dispensing is food wrap, and is formed of a plastics material.

21. A method of mounting a reel in a reel dispenser, the method including providing a reel dispenser, the reel dispenser including a housing, a coupling associated with a reel and a mounting for removably mounting the coupling to the housing so that the coupling is movable between a mounted and a dismounted condition, the coupling including a key, the key is in the form of a projecting key formation, the coupling includes a body, and the key formation projects outwardly from the body, the mounting including a lock arrangement which is movable between a locked condition and a free condition, and moving the coupling from the dismounted condition to the mounted condition, the reel dispenser being arranged so that when the coupling is moved from the dismounted condition to the mounted condition, the key moves the lock arrangement to the free condition, permitting rotation of the coupling relative to the housing.

* * * * *